United States Patent [19]

Naito et al.

[11] 4,218,930

[45] Aug. 26, 1980

[54] FALSE TWIST SPINDLE FRICTION DISC AND METHOD OF PRODUCING SAME

[75] Inventors: Akinori Naito; Masao Shimizu; Masatsugu Mori; Yukihiro Matsubara, all of Iwata, Japan

[73] Assignee: NTN Toyo Bearing Company, Limited, Osaka, Japan

[21] Appl. No.: 856,682

[22] Filed: Dec. 1, 1977

[30] Foreign Application Priority Data

Jun. 9, 1977 [JP] Japan ..... 52/68444
Sep. 5, 1977 [JP] Japan ..... 52/107093

[51] Int. Cl.[2] ..... F16H 55/34

[52] U.S. Cl. ..... 74/216; 264/273; 264/259

[58] Field of Search ..... 74/214, 215, 216, 243 R, 74/243 DR, DIG. 10, 446; 264/273, 274, 259; 29/159 R, 159.2, 159.3

[56] References Cited

U.S. PATENT DOCUMENTS

| | | | |
|---|---|---|---|
| 820,789 | 5/1906 | Hutchins | 29/159.2 |
| 2,054,210 | 9/1936 | Weisenberg | 264/273 |
| 3,272,027 | 9/1966 | Wayman | 74/243 R |
| 3,354,510 | 11/1967 | Cook | 264/273 |
| 3,613,467 | 12/1969 | Lee | 74/215 |
| 3,815,201 | 6/1974 | Conrad | 29/159 R |
| 3,821,905 | 7/1974 | Chesmer et al. | 74/216 |
| 3,990,136 | 11/1976 | Hishida | 264/274 |
| 4,033,106 | 7/1977 | Raschle | 74/216 |
| 4,080,845 | 3/1978 | Hatch | 74/574 |

FOREIGN PATENT DOCUMENTS

| | | | |
|---|---|---|---|
| 1525149 | 11/1969 | Fed. Rep. of Germany | 74/214 |
| 1226303 | 3/1971 | United Kingdom | 74/214 |

*Primary Examiner*—Samuel Scott
*Assistant Examiner*—Wesley S. Ratliff, Jr.
*Attorney, Agent, or Firm*—Armstrong, Nikaido, Marmelstein & Kubovcik

[57] ABSTRACT

A false-twist spindle friction disc comprises an annular rotor member whose lateral surfaces are machined to form coupling means and which is made of a highly rigid, centrifugal-force-resistant, high melting point material, and a support base made of a thermoplastic synthetic resin surrounding the annular rotor member while leaving the outer peripheral portion of the latter exposed. With the annular rotor member used as a core, the synthetic resin support base is formed by injection molding so as to unit them together. The presence of the coupling means formed in the lateral surfaces of the annular rotor member adds to the firmness with which the annular rotor member and the support base are united together.

9 Claims, 24 Drawing Figures

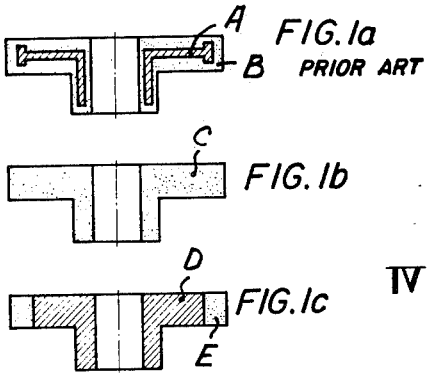
FIG. 1a PRIOR ART
FIG. 1b
FIG. 1c
FIG. 3
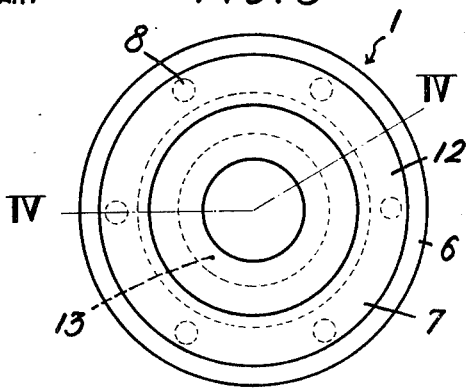
FIG. 2
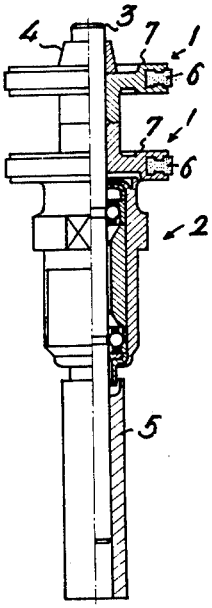
FIG. 4
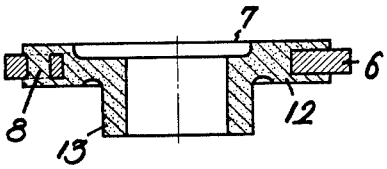
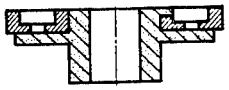
FIG. 8a
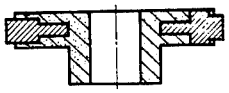
FIG. 8b
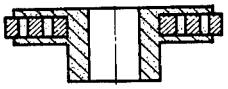
FIG. 8c
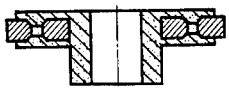
FIG. 8d
FIG. 7
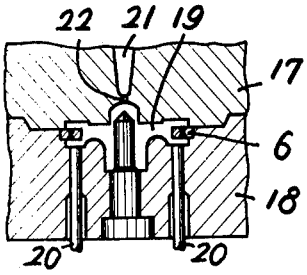

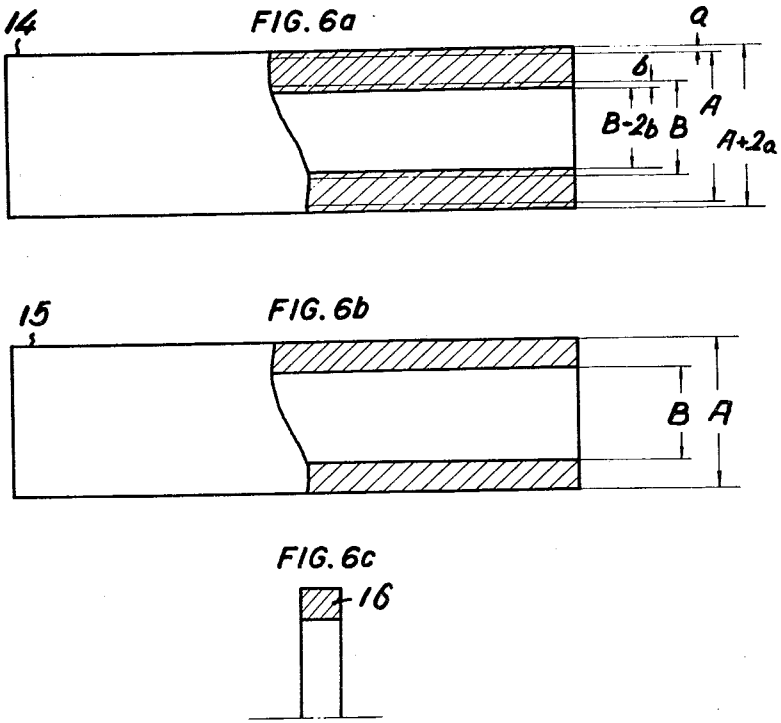
FIG. 6a
FIG. 6b
FIG. 6c
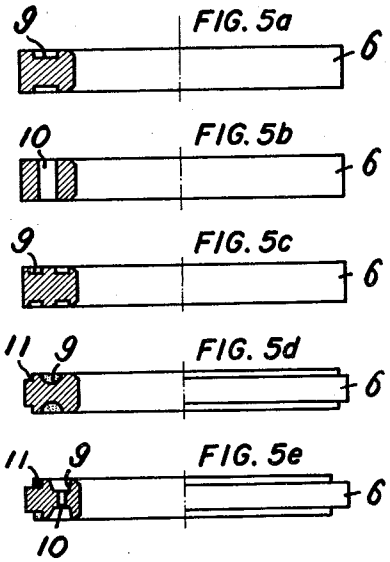
FIG. 5a
FIG. 5b
FIG. 5c
FIG. 5d
FIG. 5e

FALSE TWIST SPINDLE FRICTION DISC AND METHOD OF PRODUCING SAME

BACKGROUND OF THE INVENTION (a) Field of the Invention

This invention relates to a false twist spindle disc used in a textile machine, and more particularly it relates to a false twist spindle friction disc having an annular rotor member having high rigidity, a high resistance to centrifugal force and a high melting point (about 300° C.). It also relates to a method of producing the same.

(b) Description of the Prior Art

In a false twist spindle friction disc used in a textile machine for false twisting, urethane rubber has been frequently employed at the twisting section. As for the construction of the conventional friction discs, the following three types are relatively frequently used.

A first type is of a construction wherein, as shown in FIG. 1*a*, a core element A of non-elastic material is used and liquid rubber B is poured therearound and allowed to set. A second type is of a construction wherein, as shown in FIG. 1*b*, a rubber element is machined to form a main body C. A third type is of a construction wherein, as shown in FIG. 1*c*, a ring E of rubber is press-fitted on or bonded to the outer periphery of a core element D of non-elastic material. However, none of these conventinal constructions can be used where they are subjected to high speed rotation. More specifically, 400,000–600,000 r.p.m. has been considered to be their upper limit. The cause thereof lies in the fact that in the conventinal constructions, the rubber itself is under no or almost no restraint. Therefore, the rubber is in a condition in which it will be subjected directly to a bulging phenomenon due to centrifugal force or a pulsating phenomenon during high speed rotation. This results in scatter in the slippage rate and also causes vibrations, thus impeding high speed rotation. According to the conventional method of producing a rotor by pouring liquid rubber, generally, rubber sets in 20–40 seconds when in contact with air. In the process of setting of rubber, air bubbles are trapped in the rubber as the latter sets, frequently resulting in pinholes resembling pockmarks. Directly, said pockmark-like pinholes becomes an oil reservoir, causing slippage and also forming a cause of vibrations in the spinner rolling surface. Indirectly, they form a remote cause of the production of cracks in the rotor. In addition, various tests have revealed that the cause of decreasing the life of the rubber itself lies in the above point.

SUMMARY OF THE INVENTION

The present invention relates to a false twist spindle friction disc comprising an annular rotor member whose lateral surfaces are machined to form coupling means and which is made of a highly rigid, centrifugal-force-resistant, high melting point material, and a support base made of a thermoplastic synthetic resin surrounding said annular rotor member while leaving the outer peripheral portion of the latter exposed, wherein with the annular rotor member used as a core, the synthetic resin support base is formed by injection molding so as to unit them together, the presence of said coupling means formed in the lateral surfaces of the annular rotor member adding to the firmness with which the annular rotor member and the support base are united together.

According to the present invention, the annular rotor member is made of a highly rigid, centrifugal-force-resistant, high melting point material and machined to form coupling means in the lateral surfaces thereof, and the support base is made of a thermoplastic synthetic resin by injection molding with said annular rotor used as a core. Therefore, it is possible to provide a friction disc which is highly rigid and resistance to centrifugal force and can withstand high temperature. Further, there are no air bubbles in the annular rotor member.

As a result, the invention makes it possible to achieve a super high rotation level of 800,000–1,200,000 r.p.m. Further, whereas the conventional friction discs last generally 3–6 months or 1–3 months in the case of shorter life, at 800,000–1,200,000 r.p.m., the friction disc of the present invention can withstand use under the same conditions for more than a year. Further, with the present invention, since no air bubbles are present in the rotor member, affinity for oil is low and hence the rate of slippage relative to the twisting tube is low. With the conventional friction discs, the temperature rise caused during the rotation (600,000 r.p.m.) of the spinner is about 70° C., which, when room temperature is added thereto, becomes as high as 90° C., which has been the cause of the deterioration of rubber, In contrast, the friction disc according to the invention can withstand even about 300° C. Since the invention uses a material which will not deteriorate, the slippage rate is stabilized and hence the twist is stabilized.

BRIEF DESCRIPTION OF THE DRAWINGS

FIGS. 1*a* through 1*c* are sectional views of various conventional friction discs;

FIG. 2 is an entire view of a false twist spindle having friction discs according to the present invention incorporated therein;

FIG. 3 is a plan view of a friction disc according to the present invention;

FIG. 4 is a sectional view taken along the line IV—IV of FIG. 3;

FIGS. 5*a* through 5*e* are sectional views showing different coupling means formed in the lateral surfaces of respective annular rotors;

FIGS. 6*a* through 6*c* are explanatory views showing the production of annular rotors;

FIG. 7 is an explanatory view showing a device for forming a support base by injection molding with a friction rotor used as a core;

FIGS. 8*a* through 8*d* are sectional views of friction discs, showing different types of coupling means.

DESCRIPTION OF PREFERRED EMBODIMENTS

Figure 9:
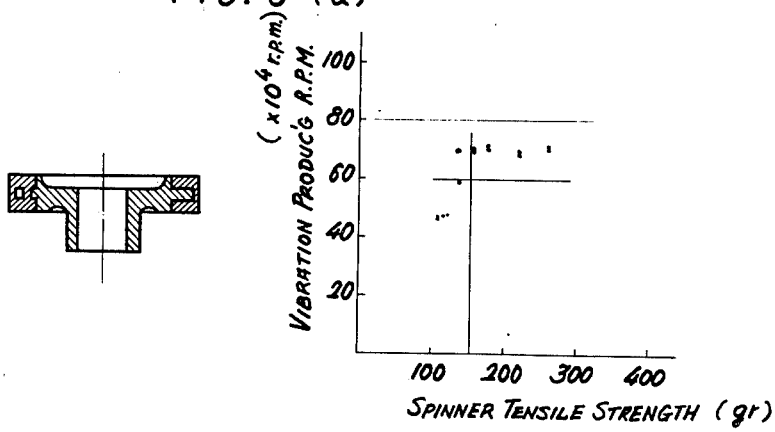
FIGS. 9*a* through 9*e* are graphs showing test data, comparing spinner tensile strength and vibration producing r.p.m. in conventional friction discs and the present inventive disc.
Figure 9:
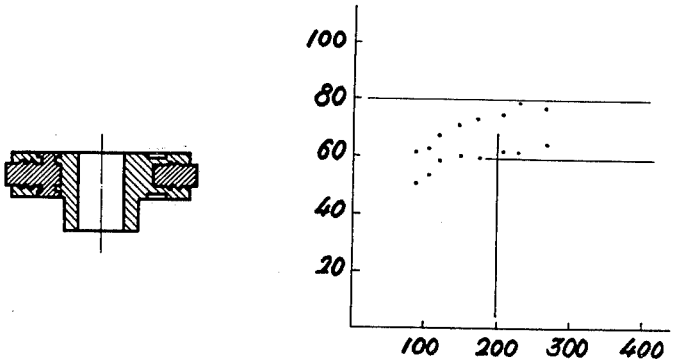
Figure 9:
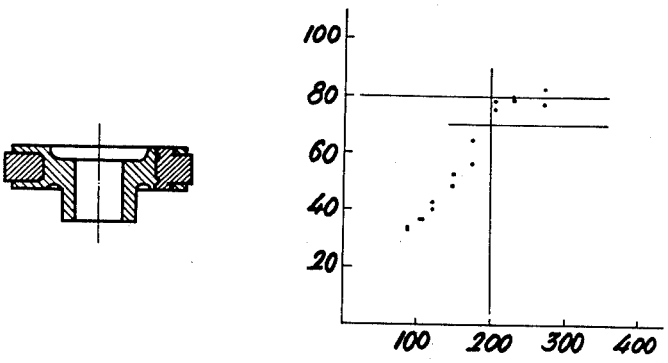
Figure 9:
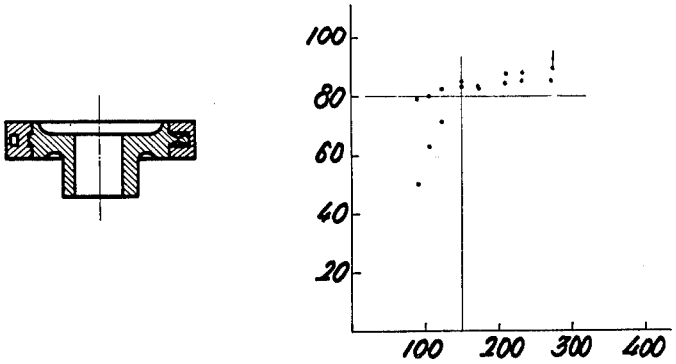
Figure 9:
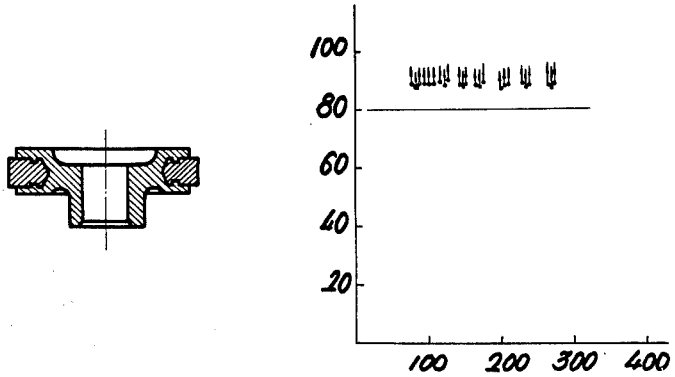

FIG. 2 is an entire view of a false twist spindle having friction discs according to the present invention incorporated therein, and in this Figure, 1 designates friction discs which are the essence of the invention; 2 designates a spindle; 3 designates a spindle shaft; 4 designates a cap; and 5 designates a belt contacting portion.

Each friction disc, as shown in FIGS. 3 and 4, comprises an annular rotor 6 and a support base 7.

The annular rotor 6 is made of polyurethane rubber, MELDIN which containes a reinforcing component such as glass fiber and carbon fiber, thermosetting resin such as phenol, metal such as aluminum, or ceramics.

The lateral surfaces of the annular rotor 6 are formed with coupling means 8 for firmly coupling or uniting the rotor and the support base 7. The coupling means 8, as shown in FIGS. 5*a* through 5*e*, is in the form of annular grooves 9, a plurality of through-holes 10, shoulders 11, or suitable combinations thereof.

The support base 7 is made of a thermoplastic synthetic resin which can be injection-molded. The support base 7 comprises a disc portion 12 surrounding said annular rotor 6 while leaving the outer periphery of the latter exposed, and a hub portion 13 extending from said disc portion, said support base formed by injection molding with said annular rotor 6 used as a core.

A method of producing friction discs according to the invention will now be described, directed to the following three kinds.

A first kind is a spinner type friction disc, wherein rigid polyurethane rubber is hardened into a mass which is then machined to form a short annular rotor member and a support base is formed by injection molding with said rotor member used as a core. A second kind is also a spinner type friction disc, wherein a cylindrical crude raw material in the form of a thermosetting resin such as MELDIN of the polymide type other than polyurethane rubber and containing a reinforcing component such as glass fiber or carbon fiber is machined to form a short annular rotor member and a support base is formed by injection molding with said rotor member used as a core. A third kind is a friction-type friction disc, wherein a cylindrical crude raw material in the form of a special material such as aluminum or ceramics is machined to form a short annular rotor member and a support base is formed by injection molding with said rotor member used as a core.

While these three kinds of friction discs are produced by the same method, their objects differ. More specifically, the first kind of friction disc using rotor member of rubber as a core is contrasted to the conventional method using liquid rubber to form a support base by pouring it into a mold wherein fine pinhole-like air bubbles due to the presence of a groove, hole and/or shoulder provided on the support base are produced during the setting of the rubber. With the first kind, however, the formation of a simple cylindrical crude raw material for rotors results in pinhole-like air bublles being gathered in the inner and outer surfaces of the raw material, said raw material being then machined to remove the portions having while cutting it into short annular rotor members, each being machined to form coupling means in its lateral surfaces, thereby eliminating the drawback of liquid rubber and reducing the cost of production. The second kind using a rotor member of a thermosetting synthetic resin, such as MELDIN, as a core is intended to develop a material which is sustituted for liquid rubber. Finally, the third kind using a rotor member of aluminum or ceramics as a core is intended to reduce the cost of production. The method of production according to the invention will now be described in more detail.

FIG. 6 shows an example of the method of producing annular rotors. First, as shown in FIG. 6*a*, a cylindrical crude raw material 14 for rotors having an outer diameter of (A+2a) mm, an inner diameter of (B−2b) mm and a length of about 100–500 mm is prepared. This crude raw material 14 is machined to reduce the outer radius by a mm and the inner radius by b mm so as to provide a precision-finished cylindrical raw material 15 having an outer diameter of A mm, an inner diameter of B mm. The raw material 15 is then sliced to provide annular member 16, as shown in FIG. 6*c*, and the annular members 16 are then machined to form coupling means 8 in their opposite lateral surfaces, as shown in FIGS. 5*a* through 5*e*, to provide the intended annular rotors 6.

Each short annular rotor member obtained in the manner described above is clamped around its outer periphery between upper and lower mold halves 17 and 18, and with the same used as a core there is defined a mold cavity 19 which corresponds to a support base which comprises a disc portion and a hub portion. An injection-moldable thermoplastic synthetic resin is then injected into said mold cavity 19. In addition, in FIG. 7, 20 designates knockout pins; 21 designates known synthetic-resin injecting means; and 22 designates a nozzle. The product is taken out of the mold shown in FIG. 7, and finally suitably worked to provide a predetermined friction disc.

FIGS. 9*a* through 9*e* are graphs showing test data, comparing spinner tensile strength and vibration producing r.p.m. in conventional article produced by the liquid rubber poring method and a present inventive article produced by the solid rubber molding method. FIGS. 9*a* through 9*d* refer to the conventional articles, while FIG. 9*e* refers to the present inventive article. As is apparent from these graphs, the present inventive article produced by the solid rubber molding method is decidedly superior in spinner tensile strength and vibration producing r.p.m., it being seen that there are problems in the conventional liquid rubber pouring method.

What is claimed is:

1. A false twist spindle friction disc adapted for use at super high rotational speeds in the range of from 800,000–1,200,000 revolutions per minute, comprising a rigid annular rotor member having an outer periphery and lateral surfaces, said lateral surfaces are machined in advance to form predetermined coupling means, a support base of synthetic resin having a hub portion and a disc portion utilizing said annular rotor as a core while leaving the outer periphery of said rotor member exposed and projecting beyond said support base, wherein said rotor member and support base form a unitized member which is rigid and resistant to centrifugal force with said disc portion being partially embedded in said coupling means for preventing bulging and pulsating of said annular rotor at super high rotational speeds.

2. A false twist spindle friction disc as set forth in claim 1, wherein the material of said annular rotor is dense, thermosetting polyurethane rubber having no air bubbles.

3. A false twist spindle friction disc as set forth in claim 1, wherein the material of said annular rotor member is a thermosetting resin such as phenol or MELDIN containing a reinforcing component such as glass fiber or carbon fiber.

4. A false twist spindle friction disc as set forth in claim 1, the material of said annular rotor member is a metal such as aluminum.

5. A false twist spindle friction disc as set forth in claim 1, wherein the material of said annular rotor member is ceramics.

6. A false twist spindle friction disc as set forth in claim 1, wherein said predetermined coupling means is in the form of holes located at frequent intervals.

7. A false twist spindle friction disc as set forth in claim 1, wherein said predetermined coupling means is in the form of notches.

8. A false twist spindle friction disc as set forth in claim 1 wherein said predetermined coupling means is in the form of a combination of holes and notches.

9. A false twist spindle friction disc as set forth in claim 1 wherein said annular rotor member has a solid continuous-diameter outer periphery.

* * * * *